US007870641B2

(12) United States Patent
Hoffmann et al.

(10) Patent No.: US 7,870,641 B2
(45) Date of Patent: Jan. 18, 2011

(54) DOOR STAY WITH SUPPORT HOUSING

(75) Inventors: Peter Hoffmann, Overath (DE); Gundolf Heinrichs, Remscheid (DE); Torsten Meissner, Remscheid (DE)

(73) Assignee: Edscha AG, Remscheid (DE)

( * ) Notice: Subject to any disclaimer, the term of this patent is extended or adjusted under 35 U.S.C. 154(b) by 67 days.

(21) Appl. No.: 11/991,949

(22) PCT Filed: Sep. 15, 2006

(86) PCT No.: PCT/DE2006/001643

§ 371 (c)(1),
(2), (4) Date: Mar. 13, 2008

(87) PCT Pub. No.: WO2007/031073

PCT Pub. Date: Mar. 22, 2007

(65) Prior Publication Data

US 2009/0070956 A1 Mar. 19, 2009

(30) Foreign Application Priority Data

Sep. 15, 2005 (DE) ..... 10 2005 044 103

(51) Int. Cl.
*E05F 5/02* (2006.01)

(52) U.S. Cl. ..... 16/82; 16/85

(58) Field of Classification Search ..... 16/82, 16/85, 86 A, 86 B, 86 C, 255, 286; 296/146.11, 296/146.12; 292/262, 265–267, 278
See application file for complete search history.

(56) References Cited

U.S. PATENT DOCUMENTS 4,581,788 A * 4/1986 Baumann ..... 16/93 D
6,842,943 B2 1/2005 Hoffmann et al.
6,901,630 B2 * 6/2005 Liang et al. ..... 16/82

(Continued)

FOREIGN PATENT DOCUMENTS

DE 296 17 518 12/1996

(Continued)

OTHER PUBLICATIONS

EPO automated translation for DE10302549.*

(Continued)

*Primary Examiner*—Victor Batson
*Assistant Examiner*—Emily M Morgan
(74) *Attorney, Agent, or Firm*—Davidson, Davidson & Kappel, LLC

(57) ABSTRACT

The invention relates to a support housing comprising a housing part for an active component of a door stay, the housing part having at a first end an opening for receiving the active component. The problem of developing a support housing which can be produced on an industrial scale easily and flexibly in line with changing requirements is solved by the invention in that the housing part comprises a cut-off extruded profile. The invention also relates to a door stay comprising a stay bar with a first side, a first active component, which co-operates with the first side of the stay bar, and a support housing with a first housing part, the first end of which is open, and with an opening for the first active component, the first housing part comprising a cut-off extruded profile.

31 Claims, 3 Drawing Sheets

U.S. PATENT DOCUMENTS

| | | | | |
|---|---|---|---|---|
| 7,530,141 | B2 * | 5/2009 | Heinrichs et al. | 16/86 C |
| 2006/0207058 | A1 * | 9/2006 | Heinrichs et al. | 16/86 B |
| 2008/0184525 | A1 * | 8/2008 | Cruz et al. | 16/85 |

FOREIGN PATENT DOCUMENTS

| | | |
|---|---|---|
| DE | 297 11 572 | 11/1998 |
| DE | 100 25 185 | 11/2001 |
| DE | 103 02 549 | 8/2004 |

OTHER PUBLICATIONS

See Search Report of the International Application No. PCT/DE2006/001643.

* cited by examiner

DOOR STAY WITH SUPPORT HOUSING

The invention relates to a support housing for a door stay, and to a door stay.

BACKGROUND

DE 103 02 549 A1 describes a door stay which comprises a door retaining bar with a first side, a first active component which is designed as a first sliding body and interacts with the first side of the door retaining bar, and a support housing, the support housing having a housing part which is open at a first end, and the first sliding body being accommodated in a receptacle for guidance in a longitudinal direction.

In this case, the housing part of the support housing is designed as a plastic part produced by injection molding. A disadvantage in this connection is that the production of the housing part is complicated, since a suitable mold has to be provided for the housing part, and is time-consuming in particular with regard to mass production. A further disadvantage is that—if changes are required to the design of the housing part—the production of easily modified housing parts can be integrated only with difficulty into a mass production process.

A particular problem is that, on account of tolerances which occur during installation, the support housing, which is fastened by one side to a sheet of the vehicle body, can enclose an angle with an action line, which is essentially provided by a rectilinear connection of the two bearing eyes of the door retaining bar, and therefore a torque may occur and force may be introduced onto the sheet of the vehicle body. A change to the design of the housing part to the effect that the side of the support housing which faces the sheet is, for its part, offset in relation to the remaining part of the support housing can only be carried out retrospectively in a highly complicated manner when support housings are manufactured as injection-molded plastic parts, and therefore, because the configuration of the support housing is not optimally adjusted, the introduction force into the sheet of the vehicle body is generally accepted as a disadvantage.

SUMMARY OF THE INVENTION

It is an object of the invention to design a support housing and a door stay of the type described at the beginning in such a manner that they can be produced in a mass production process in a simple manner and with flexibility if the requirements change If the housing part of the support housing of the door stay comprises an extruded profile which is cut to size, the housing part can be produced in large numbers in a particularly simple and rapid manner, since extrusion constitutes a through-flow process in which a malleable melt passes through a shaping die. In this case, a hollow profile can be produced in such a manner that the shaping die has an inner mandrel. The shaping die can also result in a defined external profile of the housing part. In addition to the cutting of the extruded profile to size, further process steps for the formation of the supporting part can be omitted, and therefore large piece numbers of housing parts can be produced in particular within a short time.

Should it prove necessary to have to adapt the design of the housing part, it suffices to convert the die in a suitable manner such that it is possible to react rapidly to changed requirements. In particular, it is possible in a simple manner to adapt the support housings during the course of the mass production process in a manner such that the bearing surface thereof which bears against the sheet of the vehicle body is oriented as perpendicularly as possible to the force action line and such that an introduction of force into the sheet due to a torque is minimized.

The receptacle for the active component together with the housing part preferably forms a side wall which encircles the active component on all sides, securely holds the active component and securely guides the active component, if the latter is designed as a longitudinally displaceable sliding body, at least in some sections in the longitudinal direction, with it being possible for such a hollow profile to be produced easily by means of extrusion with a die comprising a mandrel.

The housing part of the support housing preferably has an external profile which can be produced in a simple manner by shaping of the die, with it being possible for the external profile of the housing part to fulfill further functions without the extruded profile which has been cut to size having to be refinished in order to produce the external profile.

Particularly preferably, the external profile has a first profile section for a first fastening means; the first profile section can especially comprise a first and a second undercut which on both sides receive between them a head of a fastening screw provided as the first fastening means, with the support housing being able to be fixed on the sheet of the vehicle body by means of the fastening screw.

As an alternative or, preferably, in addition to the first profile section, the external profile has a second profile section for a second fastening means, the second fastening means being a rivet with a stem, and the rivet being provided in order to fasten a first and a second housing part to each other, and the second profile section being designed in such a manner that it holds the rivet stem in a form-fitting manner in some sections.

As an alternative or, preferably, in addition to one of the first profile section and the second profile section, the external profile has a third profile section in which an end stop part is accommodated. In the third profile section, the end stop part, which is designed, for example, as a material blank of a soft plastic, is accommodated between a first limb section and a second limb section, with it being possible for the end stop part to easily be fixed on the housing part of the support housing by embossing at least one of the two limb sections.

A second, open end of the housing part is preferably closed by a closure piece which is fixed on the body in a simple manner by means of a fixing embossment such that the housing part is essentially closed overall at the first end by the guided active component arranged in the open receptacle and at the second end by the closure piece.

The housing part is preferably produced from aluminum, an aluminum alloy or another light metal, such as, for example, magnesium or a magnesium alloy, the stated materials being able to be easily and inexpensively deformed, in particular by extrusion, and only having a low weight.

The support housing preferably comprises two identical housing parts which may be preferably arranged symmetrically to each other, which, may be easily possible if the two housing parts are cut to size from the same extruded profile.

The abovementioned advantages and advantageous designs of a support housing are also applicable, in particular, for a door stay which comprises a support housing designed in such a manner.

In addition to a first support housing which receives a first active component, and in addition to a door retaining bar, the door stay preferably further comprises a second support housing which receives a second active component, the first active component and the second active component interacting with the door retaining bar, and the two housings, the first support housing and the second support housing, each comprising an extruded profile which is cut to size.

The assembly of the door stay by the installation of the two support housings is simplified if the two support housings can be fixed on each other, for example by each of the two support housings having a second profile section passed through by a common fastening means.

In this connection, it is preferably provided that the common fastening means is a rivet with a first rivet stem and with a second rivet stem, the first rivet stem passing through a section of the second profile section of the first support housing, and the second rivet stem passing through a section of the second profile section of the second support housing.

The rivet preferably comprises a third rivet stem which is arranged between the first rivet stem and the second rivet stem and which keeps the two support housings at a distance from each other. The third rivet stem can be dimensioned, in particular, in such a manner that the door retaining bar bears laterally against it and is guided by it, which, during the installation of the door stay, proves favorable for an initial and easily reproducible orientation of the door retaining bar relative to the two support housings.

BRIEF DESCRIPTION OF THE DRAWINGS

The invention is described and explained in more detail below with reference to a preferred exemplary embodiment.

DETAILED DESCRIPTION

Figure 1:
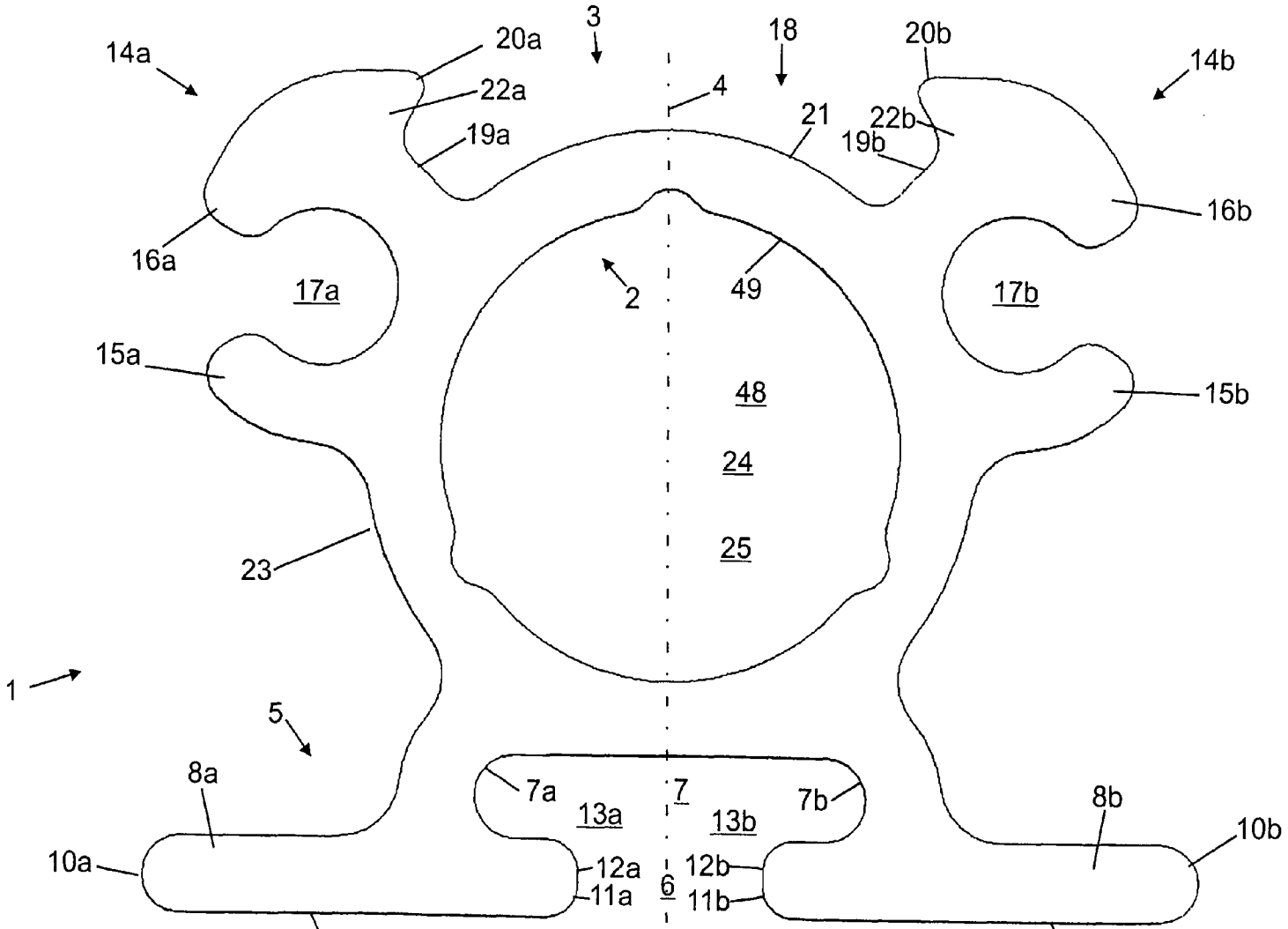
FIG. 1 shows a plan view along a longitudinal axis of an extruded profile for an exemplary embodiment of a support housing according to the invention.

FIG. 1 shows a plan view of an extruded profile 1 which extends essentially perpendicular to the plane of the paper and has an internal profile 2 and an external profile 3. The extruded profile 1 is mirror-symmetrical to an imaginary plane (straight line 4 in FIG. 1) perpendicular to the plane of the paper. The internal profile 2 is provided as a receptacle 48 for, for example an active component, for which purpose the internal profile 2 has an essentially circular side wall 49 which encircles the active component on all sides. The extruded profile has an essentially circular external contour 23 over which a first profile section 5, a second profile section 14 and a third profile section 18 protrude to the outside such that the wall thickness is also not reduced at the point at which one of the three profile sections 5, 14 or 18 is provided.

The external profile 3 of the extruded profile 1 comprises the first profile section 5 with a receiving opening 6, a receiving space 7, which is formed by a first undercut 13*a* and a second undercut 13*b* and is closed by essentially semicircular ends 7*a*, 7*b*, and two bearing sections 8*a*, 8*b*, each of which has a bearing surface 9*a*, 9*b* which is as large and flat as possible. A first end 10*a* of the first bearing section 8*a* points away from a first end 10*b* of the second bearing section 8*b*, and a second end 11*a* of the first bearing section 8*a* points toward a second end 11*b* of the second bearing section 8*b* such that the second ends 11*a*, 11*b* bound the receiving opening 6. The first ends 10*a*, 10*b* have an essentially semicircular cross section while the second ends 11*a*, 11*b* have a rectilinear section 12*a*, 12*b*, and therefore overall the receiving space 7 with the receiving opening has a T-shaped cross-sectional profile.

In particular, the first fastening section 5 can receive a first fastening means, for example a screw with a T-shaped (in a suitable sectional plane) head, and a stem. The T-shaped head of the screw may be received by the first undercut 13*a* and the second undercut 13*b* in the receiving space 7 and the lateral boundary of the cross section of the head of the screw coming to lie in an essentially form-fitting manner between the semicircular ends 7*a*, 7*b* in order to avoid a movement of the screw essentially perpendicular to the straight line 4. The stem of the screw passes through the receiving opening 6 and bears in some sections in a planar manner against the rectilinear sections 12*a*, 12*b*. Fixing of the screw along the direction of the straight line 4 enables the extruded profile to be fixed to a support, for example a sheet of a motor vehicle, with the bearing surfaces 9*a*, 9*b* being pressed in a planar manner against the sheet and providing an extensive mutual contact surface The external profile 3 of the extruded profile 1 furthermore comprises the second profile section 14 which is designed in two parts and mirror-symmetrically with respect to the plane with the straight line 4 in FIG. 1. In this case, the fastening section 14*a*, 14*b* comprises a respective first arm 15*a*, 15*b* and second arm 16*a*, 16*b*, the two arms 15*a* and 16*a* and 15*b* and 16*b* each enclosing an essentially annular space 17*a*, 17*b* over an angle of approx. 300° in such a manner that the space 17*a* or 17*b* engages in an essentially form-fitting manner around a cylindrical stem of, for example, a rivet, surrounds it in some sections and holds it in a manner such that it is secured against displacement within the plane of the paper of FIG. 1.

The external profile 3 furthermore comprises the third profile section 18 which comprises a first limb section 22*a* with a boundary surface 19*a* protruding essentially perpendicularly from the external contour, with a lug 20*a* adjoining the boundary surface 19*a*. In a mirror-inverted manner with respect to the straight line 4 in FIG. 1, the third profile section 18 comprises a second limb section 22*b* with a boundary surface 19*b* and a lug 20*b*. The limb sections 22*a* and 22*b* directly adjoin the second arm 16*a* and 16*b* of the second profile section 14 such that the second profile section 14 and the third profile section 18 are arranged directly adjacent.

The third profile section 18 accommodates, for example, a piece of material such as an end stop part for a door stay, of an approximately rectangular blank, one long edge of which bears against a section 20 of the external contour and the two short edges of which come to lie between the boundary surfaces 19*a*, 19*b*. The piece of material is then held by the lugs 20*a*, 20*b* and, by slight calking of the lugs 20*a*, 20*b*, can be firmly pressed against the section 20 of the external contour and therefore fixed on the extruded profile 1.

Extrusion enables shaped pieces with a cross section as illustrated in FIG. 1 to be produced in any desired length if a die is provided for the extrusion which has a design complementary to the cross-sectional profile from FIG. 1 as an opening for the emerging strand. The rounded edges, in particular of the first ends 10*a*, 10*b*, the second ends 11*a*, 11*b* and the ends 7*a*, 7*b*, the lugs 20*a*, 20*b* and the first arms 15*a*, 15*b* and the second arms 16*a*, 16*b* simplify the production of shaped pieces with a cross-sectional profile as illustrated in FIG. 1.

Cutting sections of the shaped piece to size produces extruded profiles 1 which are cut to size and have a first, open end 24 and a second, open end 25.

Figure 2:
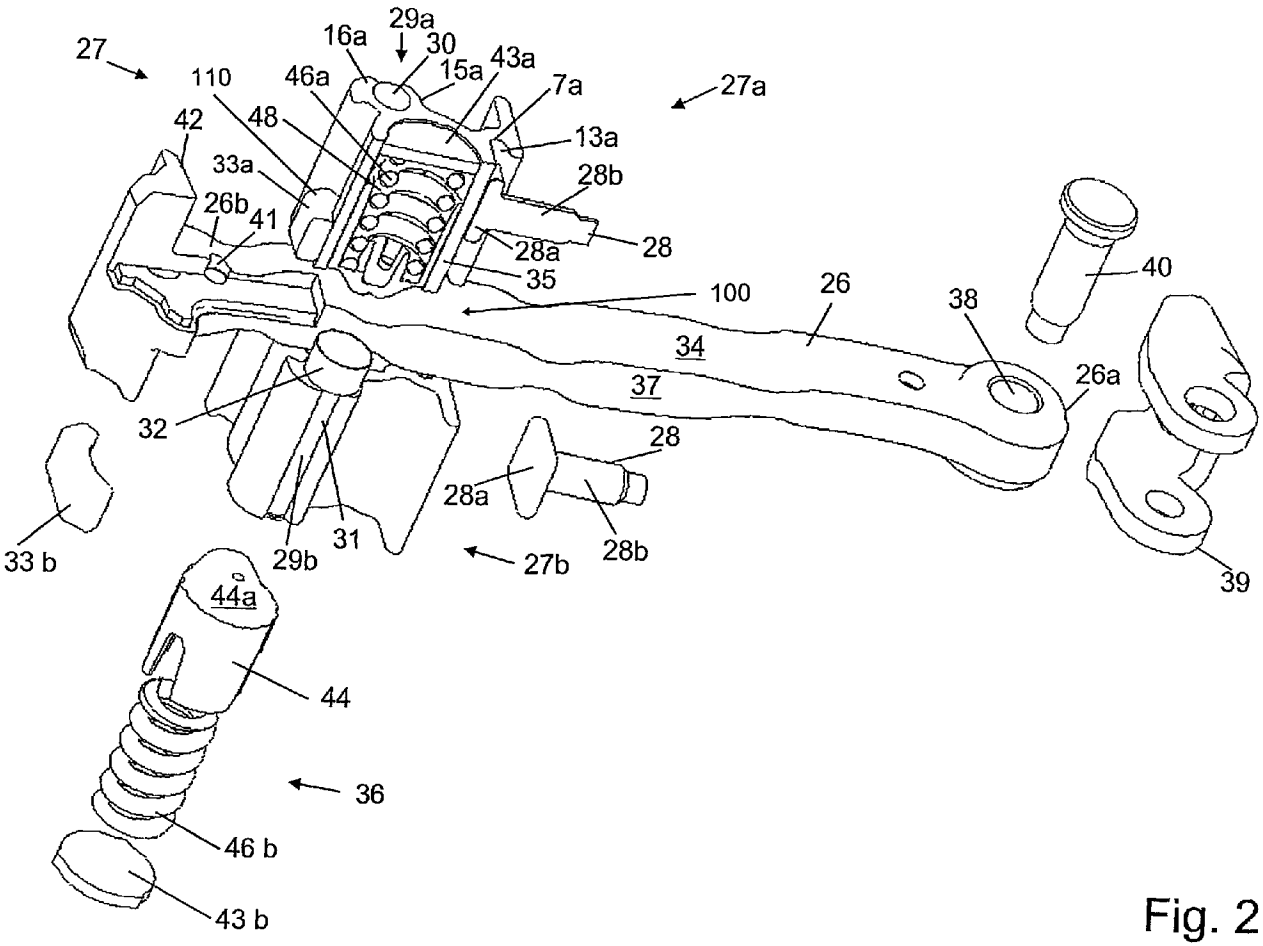
FIG. 2 shows a perspective illustration of an exemplary embodiment of a door stay according to the invention with the support housing from FIG. 1.

FIG. 2 shows a door stay which comprises a door retaining bar 26 and a support housing 27.

The support housing 27 comprises a first housing part 27*a* and a second housing part 27*b*, the two housing parts 27*a*, 27*b* having an extruded profile 1 which is cut to size and has the cross section illustrated in FIG. 1 and being composed of aluminum or of an alloy based on aluminum. The two housing parts 27*a* and 27*b* are of identical design and formed mirror-symmetrically with respect to each other—with reference to a plane essentially defined by the door retaining bar 26. Therefore, only one of the housing parts 27*a*, 27*b* is sometimes referred to below, depending on whether the first housing part 27*a*, which is shown in a sectional view, or the housing part 27*b*, which is reproduced in an exploded illustration, constitutes a feature which can be seen more clearly.

The support housing 27 comprises a screw 28 which is provided as the first fastening means and has an essentially rectangular screw head 28*a* and an essentially cylindrical screw stem 28*b*, the screw 28 having an essentially T shaped cross-sectional profile in a suitable sectional plane. In the installed position (first housing part 27*a* in FIG. 2), edges of the screw head 28*a* bear in an essentially form-fitting manner in the two undercuts 13*a*, 13*b* of the first profile section 5.

The support housing 27 comprises two similar rivets 29*a* and 29*b* which are designed as the second fastening means and the respective first rivet stem 30 of which is accommodated between the first arm 15*a* and the second arm 16*a* of the second profile section 14 of the first housing part 27*a*; FIG. 2 shows the first rivet stem 30 of the rivets 29*a* only for the first housing part 27*a*. The rivets 29*a*, 29*b* furthermore comprise a second rivet stem 31 which is shown in FIG. 2 only for the rivet 29*b* which passes through the second housing part 27*b* in the region of the second profile section 14 (FIG. 1). Each of the rivets 29*a*, 29*b* furthermore comprises a third rivet stem 32 which is illustrated in FIG. 2 only for the rivet 29*b* for the second housing part 27*b*, the third rivet stem 32 being arranged between the first rivet stem 30 and the second rivet stem 31. The third rivet stem 32 is wider than the first rivet stem 30 and the second rivet stem 31 and forms two edges, and therefore, in the installed position of the support housing 27 that is illustrated in FIG. 2, the first housing part 27*a* and the second housing part 27*b* bear against the two edges in the region of the cut surfaces, which are produced by cutting the extruded profile to size, in the region of the arms 15*a*, 15*b* and 16*a*, 16*b*.

The support housing furthermore comprises, for each of the housing parts 27*a*, 27*b*, a respective piece of material 33*a*, 33*b* made of a flexible material, for example of a soft plastic, which is fixed, for example clamped, in the respective said profile section 18 (FIG. 1) between the respective first and second limb sections 22*a*, 22*b* and, by calking of the lugs 20*a*, 20*b*, is fastened to the housing part 27*a*, 27*b*. As shown for example in FIG. 2, pieces of material 33*a*, 33*b* may be easily be fixed on housing part 27*a* by an embossing 110 at least one of limb sections 22*a*, 22*b*.

The door retaining bar 26 of the door stay comprises a first side 34 with which a first active component 35 interacts, a second side (which cannot be seen in FIG. 2) with which a second active component 36 interacts, and a first side surface 37 against which the third rivet stem 32 of the second rivet 29*b* bears, and also a second side surface (which cannot be seen in FIG. 2) against which the third rivet stem (not illustrated in FIG. 2) of the first rivet 29*a* bears such that, in particular, the door retaining bar 26 bears on both sides against sections of the rivets 29*a*, 29*b* and is guided by them. The door retaining bar 26 furthermore has, at a first end 26*a*, a first bearing bore 38 at which the door retaining bar is fastened rotatably to a bearing block 39 by means of a fixing means 40, and, at a second end 26*b*, a second bearing bore 41 to which the door retaining bar 26 can be attached rotatably by a further fixing means (not illustrated). At the second end 26*b* of the door retaining bar 26, the latter is set down essentially perpendicular to the plane defined by it, thus providing a hammer head 42 which serves as the end stop. The pieces of material 33*a* and 33*b*, which are provided as end stop parts, in the respective third profile section 18 of the two housing parts 27*a*, 27*b* interact with the hammer head 42, with the formation of the pieces of material 33*a* and 33*b* from a soft plastic ensuring a damped soft end stop.

The first active component 35 is accommodated in the first housing part 27*a* and protrudes over the first end 24 of the first housing part 27*a* in such a manner that the first active component 35 is in contact with the first side 34 of the door retaining bar. The second active component 36 is accommodated in the second housing part 27*b* and likewise protrudes over the first end 24 of the second housing part 27*b* to an extent such that, for example, a frictional interaction with the second side of the door retaining bar 26 may be possible.

A closure piece 43*a*, 43*b* is arranged at the respective second end 25 of the housing parts 27*a*, 27*b*, the closure piece closing the second end 25 and—as can be seen in the case of the first housing part 27*a*—being fixed on the first housing part 27*a* by a fixing embossment, i.e. by slight inward bending of the edge bearing against the second end 25.

The two active components 35, 36 are of similar construction and are arranged in a mirror-inverted manner with respect to each other—with reference to a plane defined by the door retaining bar 26—and comprise a sliding piece 44 of essentially hollow-cylindrical shape, the closed, rounded end 44*a* of which interacts in a frictional manner with the door retaining bar 26 and in which a spring 46*a*, 46*b* is accommodated, which spring is supported on the respective closure piece 43*a*, 43*b* and acts upon the sliding piece in the direction of the door retaining bar 26.

Figure 3:
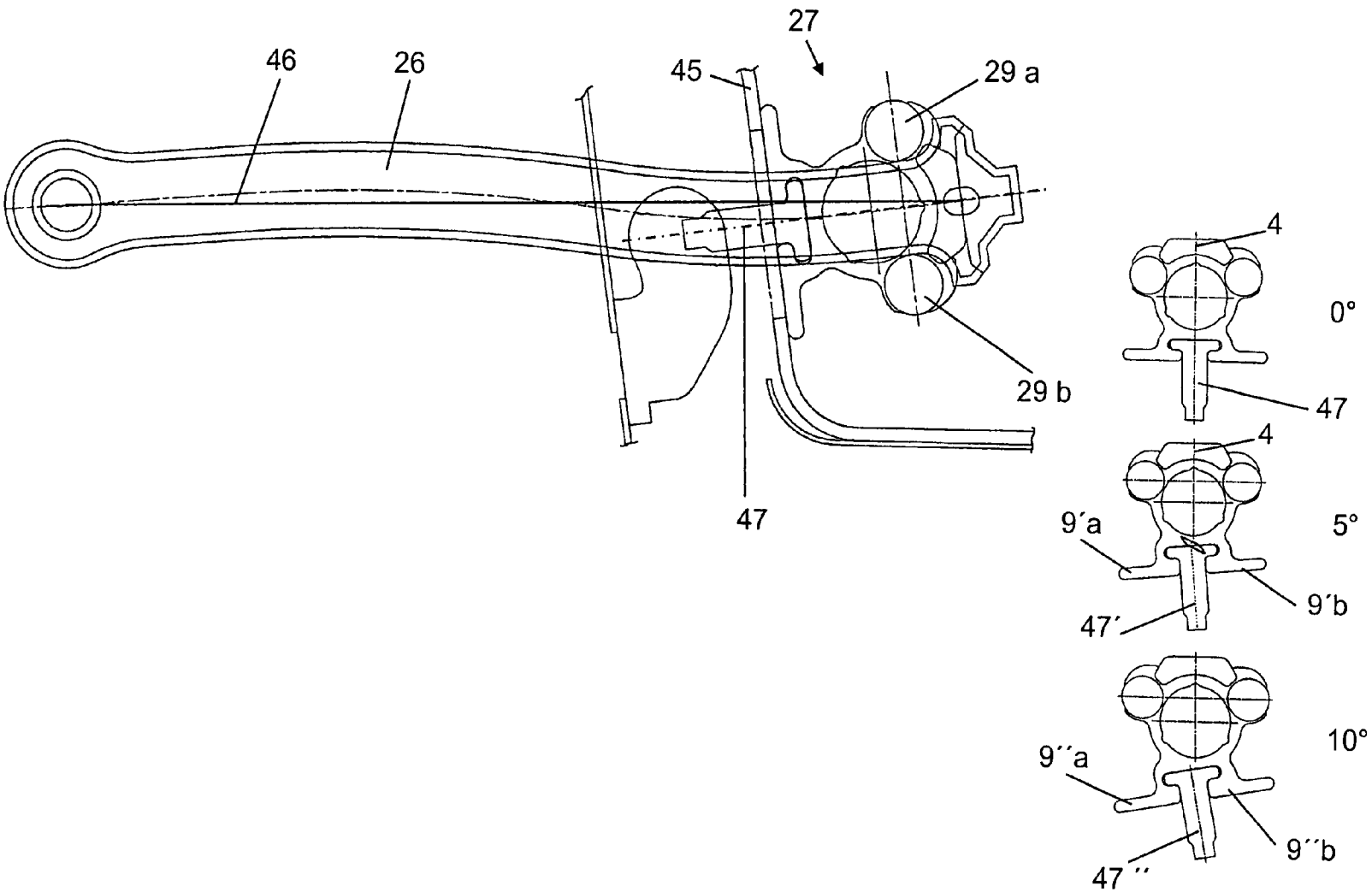
FIG. 3 shows a plan view of the door stay from FIG. 2 and the support housing from FIG. 1 and FIG. 2 in an installed position.

FIG. 3 shows the door stay and the support housing 27 from FIG. 2 in an installed position, the support housing 27 being fastened to a sheet 45 of a motor vehicle body by means of the screw 28, and the two housing parts 27*a*, 27*b* being joined together by means of the rivets 29*a*, 29*b* to form the support housing 27. In this case, the support housing 27 bears against the sheet 45 along the bearing surfaces 9*a*, 9*b* of the first profile section 5 of the external profile 5 of the two housing parts 27*a*, 27*b*.

When the active components 35, 36 interact with the door retaining bar 26, forces occur which are transmitted to the sheet 45 by the support housing 27 via the bearing surfaces 9*a*, 9*b*. The bearing surfaces 9*a*, 9*b* enclose an angle of approx. 6.5° with a force action line 46 which connects the first bearing bore 38 and the second bearing bore 39 of the door retaining bar 26 to each other, and therefore the forces which occur are not transmitted uniformly to the sheet 45 and a torque occurs which may distort the sheet.

In the case of the support housing 27 illustrated in FIG. 3, a perpendicular 47 to the bearing surfaces 9*a*, 9*b* encloses an angle of approx. 0° with the straight line 4 (FIG. 1) which indicates the orientation of the remaining parts of the housing parts 27*a*, 27*b* and of the support housing 27 (partial image 3*a* belonging to FIG. 3).

The occurrence of the torque can be suppressed by the bearing surfaces 9*a*, 9*b* being arranged essentially perpendicular to the direction of the force action line 46, for which purpose the bearing surfaces 9*a*, 9*b* are to be rotated in relation to the rest of the support housing 27, and therefore, for example for an improved support housing 27', the bearing surfaces 9'*a*, 9'*b* are designed such that they are rotated through approx. 5° in relation to the remaining parts and the angle enclosed between the force action line 46 and the perpendicular 47' to the bearing surfaces 9'*a*, 9'*b* is significantly reduced (partial image 3*b* belonging to FIG. 3). It has to be understood that, if required, greater angles (10° or more, partial image 3*c* belonging to FIG. 3) can be provided between the perpendicular 47" and the force action line 46 in order to permit an orientation of the bearing surfaces 9"*a*, 9"*b* essentially perpendicular to the force action line 46.

The modifications illustrated in FIG. 3, partial images 3*b* and 3*c*, can be set rapidly even for a mass production process if the die for the extruded profile 1 (FIG. 1) is correspondingly adapted such that there can be a flexible reaction even to changed requirements.

The invention now functions as follows:

Starting from the predetermined cross section of a housing part, as illustrated in FIG. 1 and in the partial images 3*a* to 3*c* belonging to FIG. 3, a die is provided, the outlet opening of which, for letting out an extruded profile, is covered by the cross section of the housing part. The extrusion then produces a shaped part of essentially any desired length, with the internal profile 2 and the encircling side wall 49 and the external profile 3. At least one of the extruded profiles 1 is cut to size from the shaped part, and therefore the extruded profile which is cut to size has an open first end 25, which is provided together with the side wall 49 as a receptacle 48 for the active component 35, 36, and a second open end 26.

The open second end 25 is closed by means of the closure piece 43*a* or 43*b*, for example by the edge bearing against the second end 25 being calked. The piece of material 33*a*, 33*b* which is provided as the end stop part is subsequently introduced into the third profile section 18 and fixed there by calking of the lugs 20*a*, 20*b*.

The active component 36, 37 is subsequently introduced into the open first end 24 of the housing part 27*a*, 27*b* and accommodated there.

The two housing parts 27*a*, 27*b* are joined to form the support housing 27, for which purpose two rivets 29 pass together through the spaces 17*a*, 17*b* of the two profile sections 14 of the two housing parts 27*a*, 27*b*. In the process, the mutually facing first ends 24 of the two housing parts 27*a*, 27*b* rest with the respective arms 15*a*, 15*b*, 16*a* and 16*b* in the region of the first ends 24 on the third rivet stem 32 of the two rivets 29, and therefore the third rivet stem 32 keeps the two housing parts 27*a*, 27*b* at a distance from each other, the distance between housing parts 27*a*, 27*b* defining an opening 100.

The screws 28 for fastening the support housing 27 to the sheet 45 are subsequently fitted in such a manner that the screw heads 28*a* are introduced into the first undercuts 13*a* and second undercuts 13*b* of the first profile sections 5 of the two housing parts and then the screws 28 are fixed to the sheet 45.

Finally, the door retaining bar 26 is introduced, the side surface 37 of which bears against the respective third rivet stem 32 of the two rivets 29 and is guided during initial installation and impeded in the installed position in a manner such that it does not come out. The door stay is finally attached in a functional position by incorporating the first bearing bore 38 and the second bearing bore 41.

In the exemplary embodiment described above, the piece of material 33*a*, 33*b* provided as the end stop part is fixed to the extruded profile 1 by calking of the limb sections 22*a*, 22*b* of the third profile section 18. It has to be understood that a different type of fixing can also be provided, for example the end stop part can also be fastened to the section 21 of the external contour by adhesive bonding. As an alternative or in addition, it can be provided to bend the piece of material provided as the end stop part in such a manner and to introduce it in a bent and therefore braced manner into the third profile section 18 that it is accommodated between boundary surfaces 19*a*, 19*b* and is prevented from dropping out by the lugs 20*a*, 20*b*.

The present invention has been described above with reference to an exemplary embodiment in which the active components 35, 36 are accommodated in the housing part 27*a* and 27*b* in a manner guided such that they slide essentially perpendicular to the associated side of the door retaining bar 26. Other active components can also be accommodated in the housing part, for example active components which comprise one or more rollers which then roll on the side of the door retaining bar and in which the interaction of the active component with the door retaining bar is essentially based on rolling friction. A mounting for the roller is then arranged in the housing part.

In the exemplary embodiment described above, the first profile section 5 was designed with the two undercuts 13*a*, 13*b* in such a manner that the screw head 28*a* of the screw 28 with an essentially T-shaped cross section was accommodated in the undercuts 13*a*, 13*b*. A different profile shaping can also be provided, for example, a screw can have an essentially hemispherical or at least approximately spherical screw head which can then be accommodated in a first profile section with a cross-sectional design essentially complementary thereto.

The invention claimed is:

1. A motor vehicle door arrester, comprising:

a support housing, and a door retaining bar having a first surface and penetrating an opening of the support housing, wherein the support housing comprises a first housing part and a second housing part, the first housing part and a second housing part being connected so as to define the opening, wherein a first active component received in the first housing part urges against the first surface of the door retaining bar to generate a braking force, wherein at least the first housing part comprises a cut to size extruded profile such that the first housing part has a continuous cross-sectional profile over the length thereof, the first housing part having a receptacle and being made of one of aluminum and an aluminum alloy, wherein the receptacle comprises a first open end facing the door retaining bar to allow the first active component to protrude, and wherein the receptacle comprises a second open end that is closed by a closure piece.

2. A support housing, comprising:

a first housing part for an active component of a door stay, the first housing part having a receptacle for receiving the active component, the first housing part being open at a first end, wherein the first housing part comprises an extruded profile which is cut to size such that the first housing part has a continuous cross-sectional profile over the length thereof.

3. The support housing as claimed in claim 2, wherein the receptacle together with the first housing part forms a side wall which encircles the active component on all sides.

4. The support housing as claimed in claim 2, wherein an external profile is arranged on the first housing part.

5. The support housing as claimed in claim 4, wherein the external profile comprises a first profile section for a first fastening device.

6. The support housing as claimed in claim 5, wherein the first fastening device is a screw having an essentially T-shaped screw head, wherein the first profile section comprises a first undercut and a second undercut, and wherein the first undercut and the second undercut receive the screw head of the screw.

7. The support housing as claimed in claim 4, wherein the external profile comprises a second profile section shaped for holding a second fastening device in a form-fitting manner.

8. The support housing as claimed in claim 7, wherein the second fastening device is designed as a rivet having a stem, and wherein the second profile section includes two arms that enclose the stem of the rivet in some sections of the stem of the rivet.

9. The support housing as claimed in claim 7, wherein the external profile comprises a third profile section.

10. The support housing as claimed in claim 9, wherein an end stop part is accommodated in the third profile section, the third profile section enclosing the stop part in some sections of the stop part.

11. The support housing as claimed in claim 10, wherein the end stop part comprises a piece of material made of a soft plastic which is fixed in the third profile section.

12. The support housing as claimed in claim 11, wherein the third profile section comprises a first limb section and a second limb section, wherein the piece of material is clamped between the first limb section and the second limb section, and wherein the piece of material is fixed on the first housing part by a first embossing of the first limb section and by a second embossing of the second limb section.

13. The support housing as claimed in claim 2, wherein the receptacle comprises a second, open end.

14. The support housing as claimed in claim 13, wherein a closure piece is fastened to the second end, and wherein the closure piece closes the second end.

15. The support housing as claimed in claim 14, wherein a fixing embossment is provided at the second end, and wherein the fixing embossment fixes the closure piece on the first housing part.

16. The support housing as claimed in claim 2, wherein the first housing part is produced from aluminum or an aluminum alloy.

17. The support housing as claimed in claim 2, further comprising a second housing part, the second housing part comprising an extruded profile which is cut to size such that the second housing part has a continuous cross-sectional profile over the length thereof.

18. The support housing as claimed in claim 17, wherein the first housing part and the second housing part are arranged mirror-symmetrically with respect to each other.

19. A door stay, comprising:

a door retaining bar having a first side, a first active component which interacts with the first side of the door retaining bar, and a support housing having a first housing part being open at a first end defining a receptacle for the first active component, wherein the first housing part comprises an extruded profile which is cut to size such that the second housing part has a continuous cross-sectional profile over the length thereof.

20. The door stay as claimed in claim 19, further comprising:

a second active component which interacts with the door retaining bar, and a second housing part having a first, open end defining a receptacle for the second active component.

21. The door stay as claimed in claim 20, wherein the second housing part comprises an extruded profile part which is cut to size such that the second housing part has a continuous cross-sectional profile over the length thereof.

22. The door stay as claimed in claim 20, wherein the first housing part is assigned to the first side of the door retaining bar and the second housing part is assigned to a second side of the door retaining bar, which second side faces away from the first side of the door retaining bar.

23. The door stay as claimed in claim 22, wherein the first housing part and the second housing part have external profiles and are fixed on each other by means of a common fastening device having a first portion that is received in a form-fitting manner in the external profile of the first housing part and a second portion that is received in a form-fitting manner in the external profile of the second housing part.

24. The door stay as claimed in claim 23, wherein the common fastening device is a rivet, the first portion being a first rivet stem of the rivet being fixed on the first housing part and the second portion being a second rivet stem of the rivet being fixed on the second housing part.

25. The door stay as claimed in claim 24, wherein the rivet comprises a third rivet stem which is arranged between the first rivet stem and the second rivet stem, and wherein the third rivet stem has a greater diameter than the first rivet stem and the second rivet stem so the third rivet stem keeps the first housing part and the second housing part from contacting each other.

26. The door stay as claimed in claim 24, wherein the door retaining bar bears laterally against the third rivet stem.

27. The motor vehicle door arrester recited in claim 1 further comprising a fastening device connecting the first housing part and the second housing part, the second housing part having a first end facing the door retaining bar, the fastening device holding the first open end of the receptacle from the first end of the second housing part to space the first housing part from the second housing part.

28. The motor vehicle door arrester recited in claim 27 wherein the fastening device includes a middle portion that is positioned between the first open end of the receptacle and the first end of the second housing part to hold the first open end of the receptacle from the first end of the second housing part.

29. The motor vehicle door arrester recited in claim 17 further comprising a fastening device connecting the first housing part and the second housing part, the first housing part having a first end facing the second housing part and the second housing part having a first end facing the first housing part, the fastening device holding the first end of the first housing part from the first end of the second housing part to space the first housing part from the second housing part.

30. The motor vehicle door arrester recited in claim 29 wherein the fastening device includes a middle portion that is positioned between the first end of the first housing part and the first end of the second housing part to hold the first end of the first housing part from the first end of the second housing part.

31. A motor vehicle door arrester, comprising:

a first housing part having a continuous cross-sectional profile over the length of the first housing part, the first housing part comprises a cut to size extruded profile, a second housing part having a continuous cross-sectional profile over the length of the second housing part, the second housing part comprises a cut to size extruded profile, wherein a first portion of the first housing part is configured to accommodate a first end of a fastening device for fastening the first housing part and the second housing part to each other, wherein a second portion of the second housing part is configured to accommodate a second end of the fastening device, wherein an intermediate portion of the fastening device between the first end and the second end of the fastening device bridges a gap between the first housing part and the second housing part, and wherein the intermediate portion of the fastening device is at least as large as a thickness of a retaining bar traversing the door arrester housing.

* * * * *